US005366248A

United States Patent [19]

Donvan et al.

[11] Patent Number: 5,366,248

[45] Date of Patent: Nov. 22, 1994

[54] STUDENT CASE AND FILE FOR USE THEREWITH

[76] Inventors: Robert G. Donvan; Michael D. Donovan, both of 15 East La., Pittston, Pa. 18640

[21] Appl. No.: 109,360

[22] Filed: Aug. 20, 1993

[51] Int. Cl.[5] ..... B42D 1/06

[52] U.S. Cl. ..... 281/46; 229/1.5 R; 281/31

[58] Field of Search ..... 281/46, 47, 31, 48, 281/49, 50; 40/359; 229/1.5 R

[56] References Cited

U.S. PATENT DOCUMENTS

| | | | |
|---|---|---|---|
| 4,301,962 | 11/1981 | Monckton et al. | 329/1.5 R |
| 4,419,837 | 12/1983 | Meeker | 40/359 |
| 4,530,176 | 7/1985 | Rejwan | 40/359 |
| 4,659,109 | 4/1987 | Donovan | 281/46 |
| 5,236,226 | 8/1993 | Sheffield | 281/48 |

*Primary Examiner*—Richard K. Seidel
*Assistant Examiner*—Hwei-Siu Payer
*Attorney, Agent, or Firm*—Watson, Cole, Grindle & Watson

[57] ABSTRACT

A case supports a multi-leafed notebook and a file. The notebook is supported by a pair of spaced brackets having prongs extending toward one another with a prong of each bracket inserted between leaves of the notebook. A prong on one bracket has a depending portion to prevent the notebook from escaping the prong. A stop member is movably mounted on one bracket and engages the notebook to prevent inadvertent release of the notebook. The stop member has a scalloped edge for engaging the prongs. Support pockets are disposed on the front and back parts of the case by a single sheet of material having an intermediate part sealed to the hinge of the case. A file support pocket is formed by a sheet of material having free side edges. The file has a cover member and a plurality of interior members pivotally connected to one another along fold lines. The cover member includes an integral storage pocket, and each interior member has an integral storage pocket on each of its opposite faces. The interior members also have slots therein receiving the corners of homework record cards. Each storage pocket has spaced slits for receiving opposite ends of a pocket tag.

18 Claims, 4 Drawing Sheets

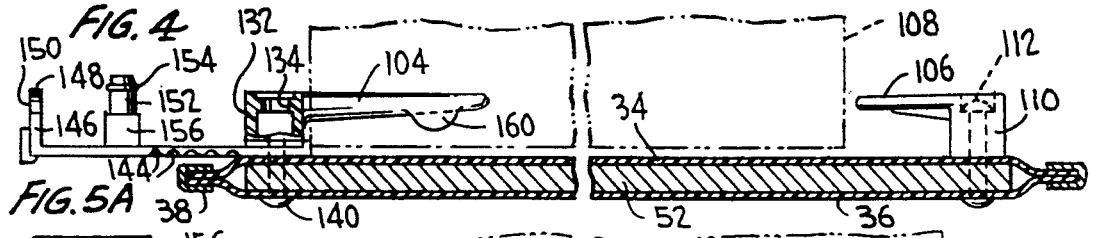
FIG. 4
150
148
154
152
146
156
144
132
134
104
160
108
34
106
112
110
38
140
52
36
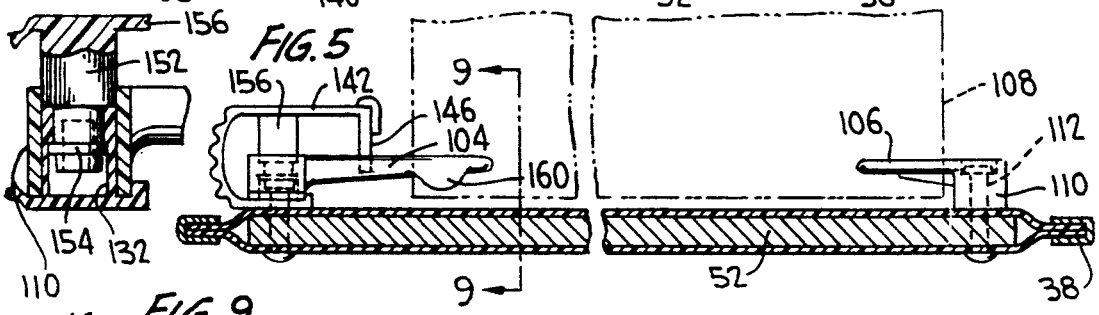
FIG. 5A
156
152
154
132
110
FIG. 5
156
142
146
104
160
9
108
106
112
110
52
38
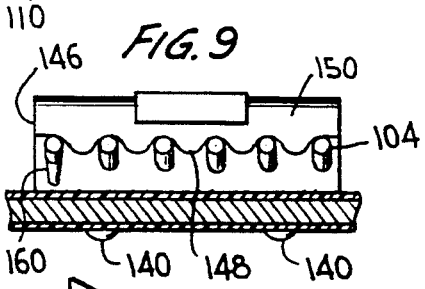
FIG. 9
146
150
104
160
140
148
140
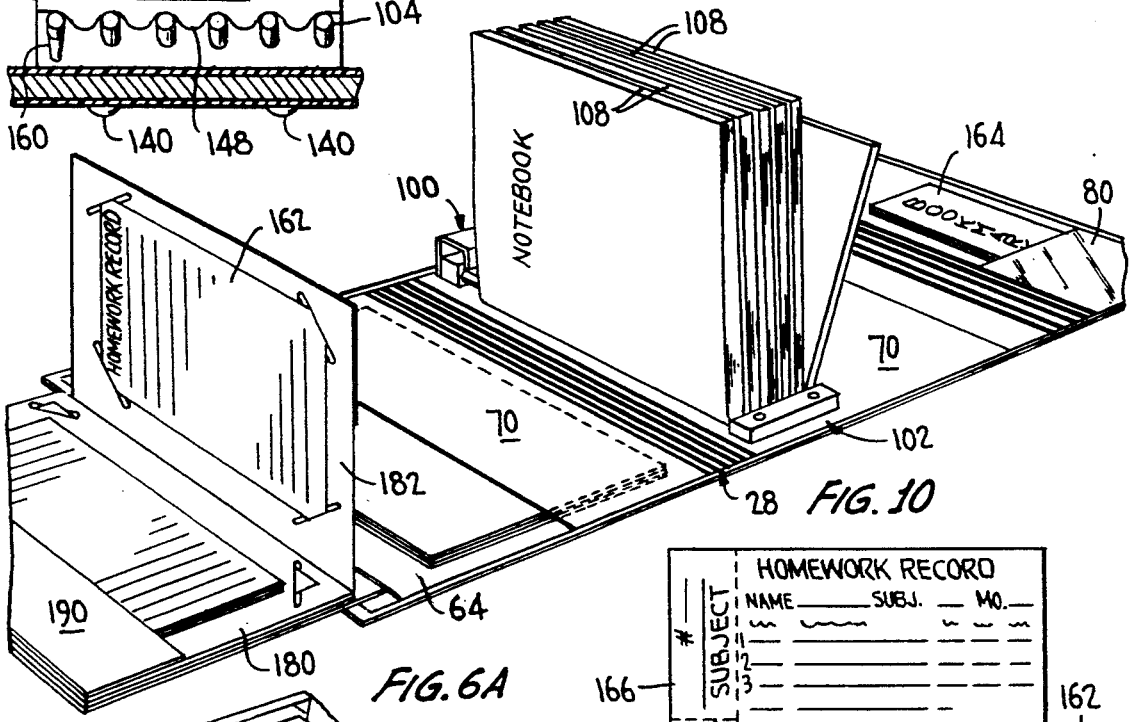
FIG. 6
108
108
NOTEBOOK
100
164
80
162
HOMEWORK RECORD
70
70
102
182
28
190
64
180
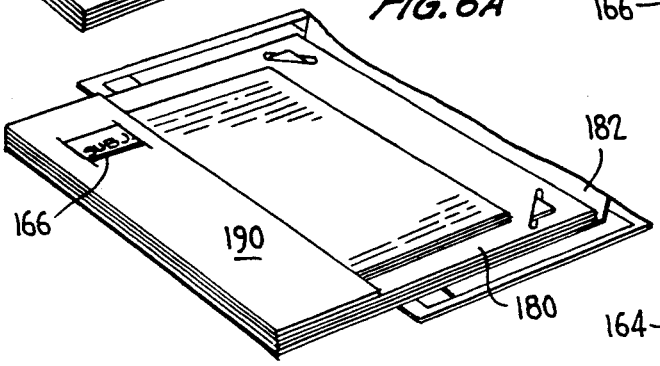
FIG. 6A
SUBJ.
166
190
182
180
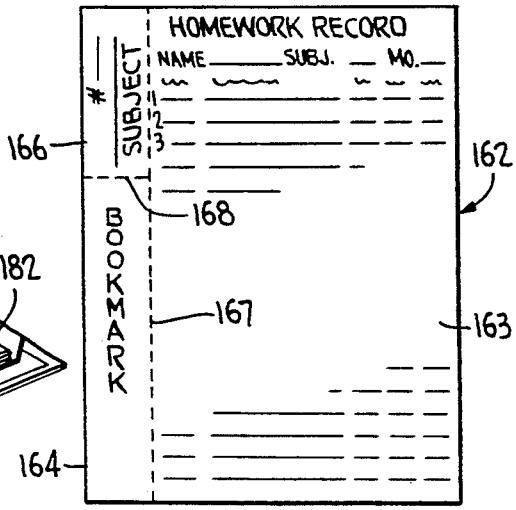
FIG. 10
HOMEWORK RECORD
NAME
SUBJ.
MO.

SUBJECT
1
2
3
BOOKMARK
166
168
167
164
162
163

STUDENT CASE AND FILE FOR USE THEREWITH

BACKGROUND OF THE INVENTION

The present invention relates to a student case and file which are utilized in an educational program in schools. This program is directed to improving a student's organizational skills and to fostering better communication between the teacher in a school and the student's parents at home.

It is a well-recognized fact that many students are not well organized, and furthermore, the parents of many students are not adequately informed and involved in their children's education. It is a particular objective of the invention to provide unique articles which will enable students to acquire organizational skills and which will enable the students' parents to be better informed.

The articles of the invention are designed to improve academic performance through a reduction in missed assignments, lack of preparation and wasted time, while establishing a channel of communication between school and the home. Additionally, the articles are so designed that getting organized and staying organized is easy, fun and interesting for students.

There is a well-established correlation between student organization and performance. Organization instills confidence within students and generates a feeling of being prepared to learn. The student needs to learn what organization is and why it is important.

It is also important to ensure that parents are able to monitor the students academic progress and homework assignments. Homework is a vital factor in increasing student achievement. Cooperation and communication between the school and home are essential if home assignments are to make a significant contribution to the student's education.

The invention includes a student case which represents an improvement over prior U.S. Pat. Nos. 3,950,012 and 4,659,109, the disclosures of which are incorporated herein by reference.

SUMMARY OF THE INVENTION

The student case of the invention is provided with means for supporting all the necessary components of a system according to the invention. The case incorporates a special arrangement for supporting a plurality of multi-leafed devices such as notebooks therein in such a manner that the notebooks can be opened flat, or can be readily removed when desired. These notebooks are preferably of different colors for different subjects, and various other components of the system may also be of different colors, thereby enabling color coding of the components so that all components relating to a single school subject may be of the same color which is different from the colors of all other school subjects.

The notebooks are mounted on prongs on spaced brackets. The prongs may be of any number, but six prongs are considered optimal. Accordingly, six different notebooks relating to six different school subjects can be removably mounted on the spaced brackets. One of the brackets of the invention and a cooperating stop means incorporates certain features to prevent the notebooks from being accidentally disengaged from the prongs of the associated bracket. Furthermore, means is provided for stabilizing the one bracket and the associated stop means when notebooks are supported thereon.

The interior of the case has a plurality of support pockets thereon for supporting various components of the system. A first support pocket located at the inside of the front portion of the case supports a file within the case. This file is of unique construction including a cover member and a plurality of interior members all of which are pivotally interconnected with one another. The construction is such that the members are divided into panels, and when the file is opened, any two adjacent panels include an integral storage pocket on one panel and a plurality of slots on the other panel for supporting a homework record card in place thereon. The storage pocket includes means for mounting a subject card thereon identifying the subject involved. The homework record card and the subject card are color coded to be the same color as the notebook for the particular school subject.

The homework record card includes the date, the assignment, when due, and also provides spaces for the parent and teacher to initial to indicate that the homework has been completed. The storage pocket is used to store homework and other papers relating to the particular school subject. The file can be readily removed from the case when so desired.

A further support pocket is located at the inside of the front portion of the case and is adapted to receive and support all handouts that are to be taken home and given to the student's parents. A utility support pocket is located at the inside of the back portion of the case and is adapted to support a notepad and all other items or papers that don't belong in other pockets.

A small support pocket is also located at the inside of the back portion of the case for supporting a pen or pencil. An additional pocket is also located at the inside of a flap of the case to support bookmarks. These bookmarks as well as the subject cards previously mentioned may be originally detachably connected to the homework record card and subsequently removed therefrom. The bookmarks are also color coded for a particular subject and may be inserted in the school subject textbook to mark a page in the textbook.

The articles of the invention enable the student to keep all of his papers relating to various subjects in one convenient case while materials relating to particular subjects are grouped together. The homework record cards are filled in by the student to indicate an assignment on a particular date. The parent can review the assignment and initial the card when the assignment is completed. The teacher can also initial the card. In this manner both the parents and the teacher can monitor the completion of homework. The teacher can periodically check the student's case to measure how well the student is maintaining the components within his case. The student can then receive a grade for "organization".

BRIEF DESCRIPTION OF THE DRAWINGS

FIG. 4 is a sectional view on an enlarged scale taken along line 4—4 of FIG. 1;

FIG. 5 is a view similar to FIG. 4 showing the structure in a different position;

FIG. 5A is an enlarged section through the locking means of FIG. 5;

FIGS. 6 and 6A represent a top perspective view, partly broken away, showing the case in open position with various components supported therein;

FIG. 9 is a sectional view taken along line 9—9 of FIG. 5;

FIG. 10 is a view of a sheet of printed material including several separable components used in the system of the invention;

DESCRIPTION OF THE PREFERRED EMBODIMENT

Figures 1, 2, 3:
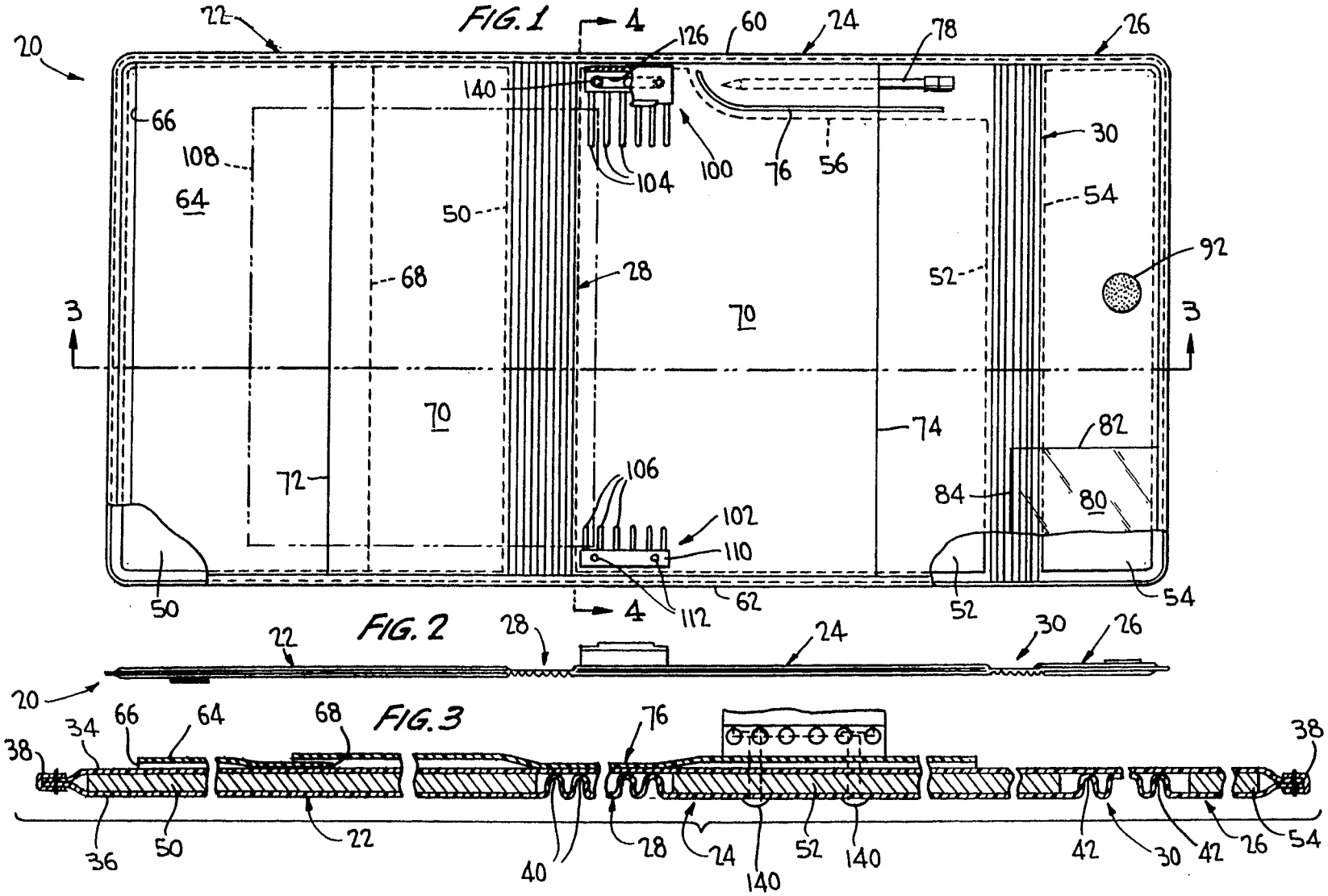
FIG. 1 is a top view of the case, partly broken away, showing the case in open position.
FIG. 2 is a front view of the case shown in FIG. 1.
FIG. 3 is a sectional view on an enlarged scale taken along line 3—3 of FIG. 1.

Referring now to the drawings wherein like reference characters designate corresponding parts throughout the several views, as seen in FIGS. 1 and 2, a case indicated generally by reference character 20 includes a front portion 22, a back portion 24 and a flap portion 26. The front portion and the back portion are interconnected with one another by hinge means 28; and the back portion and the flap portion are interconnected with one another by hinge means 30. These hinge means enable the case portions to which they are connected to swing relative to one another.

As seen most clearly in FIG. 3, the case includes a first sheet 34 of suitable plastic material which defines the inner side of the case and a second similar sheet 36 which defines the outer side of the case, the outer peripheries of the two sheets being interconnected to one another by a binding 38 having a generally U-shaped cross section which is stitched to sheets 34 and 36 throughout the peripheral portions thereof. Sheet 36 is provided with a plurality of grooves 40 formed integrally therein, the bottom of the grooves being heat sealed to sheet 34 to form the hinge means 28. Sheet 36 is also provided with a plurality of grooves 42 formed integrally therein, the bottom of the grooves being heat sealed to sheet 34 to form the hinge means 30. Three reinforcement members 50, 52 and 54 the outlines of which are indicated in dotted lines are provided between sheets 34 and 36 of the front portion, the back portion and the flap portion respectively to provide rigidity to the case. The reinforcement members may be formed of stiff cardboard, for example, and are configured so as to substantially fill the space between sheets 34 and 36 in the respective case portions except for member 52 which has an upper edge 56 as seen in FIG. 1 to enable a pen or pencil pocket to be formed in the case as hereinafter described.

The case includes an upper longitudinal edge 60 and a lower longitudinal edge 62. A plurality of support pockets are disposed on the inner side of the front and back portions, each of these support pockets being formed by sheets of material having opposite longitudinal edges extending between and being secured to the upper and lower longitudinal edges of the front and back portions of the case. A file support pocket is formed on the front portion of the case by a sheet of material 64 formed of a suitable plastic and including upper and lower longitudinal edges which are secured to the upper and lower longitudinal edges of the front portion of the case by the binding 38 the stitches of which pass through the longitudinal edges of sheet 64 and the front portion of the case. The sheet of material includes side edges 66 and 68 which are free of the front portion of the case to form a support pocket open at both sides thereof.

A sheet of material 70 formed of a suitable plastic includes a pair of free side edges 72 and 74. The upper and lower longitudinal edges of sheet 70 are secured to the upper and lower longitudinal edges of the front portion and back portion of the the case by the binding 38 the stitches of which pass through the longitudinal edges of sheet 70 and the front and back portions of the case. The intermediate portion 76 of sheet 70 overlying hinge means 28 is heat sealed to the inside of the case. In this manner, a parent support pocket is formed by sheet 70 to the left of hinge means 28 as seen in FIG. 1, and a utility pocket is formed by sheet 70 to the right of hinge means 28. The two pockets are open at the side edges 72 and 74 respectively.

A pen or pencil support pocket is formed by heat sealing sheet 70 to the case along line 76 as seen in FIG. 1. A pencil 78 is shown as being supported within this last-mentioned pocket.

A bookmark support pocket is formed by a sheet of material 80 formed of suitable plastic and forms with the flap a pocket for supporting bookmarks therein. The sheet of material includes a longitudinal edge 82 and a side edge 84. The left hand portion of the longitudinal edge which overlaps hinge means 30 and the side edge 84 are heat sealed to the inner side of the hinge means, while the opposite longitudinal edge and side edge are disposed within the binding 38 and secured to corresponding edges of the flap portion of the case by the binding stitching. The part of edge 82 to the right of the hinge means 30 in FIG. 1 is a free edge of the pocket for receiving bookmarks within the pocket.

Figure 7:
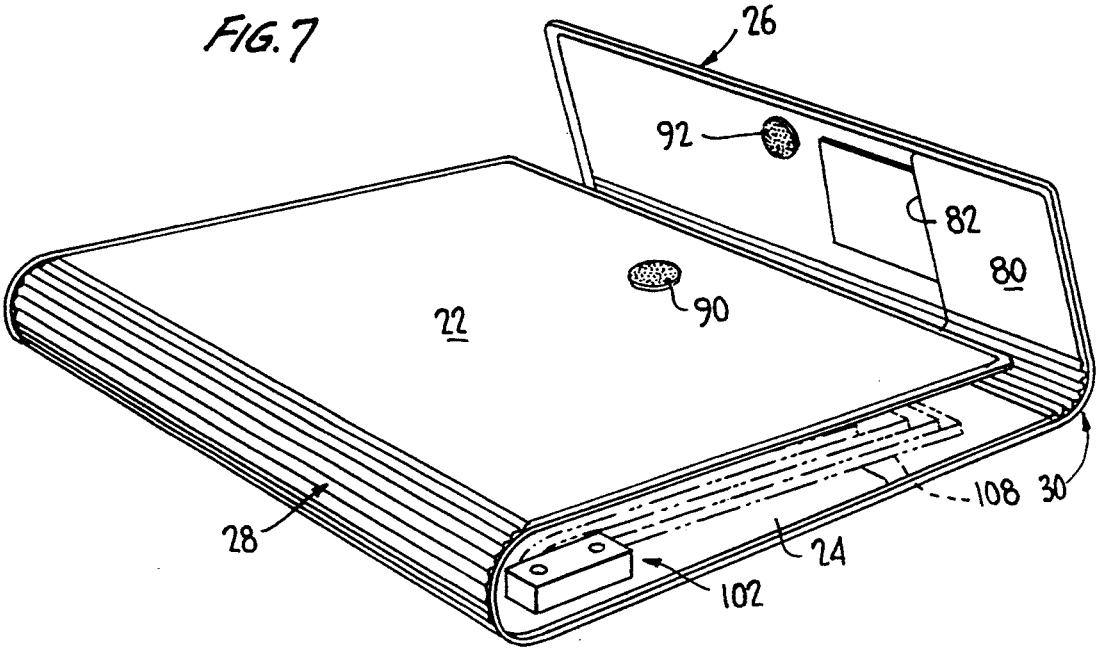
FIG. 7 is a top perspective view showing the case partly open.
Figure 8:
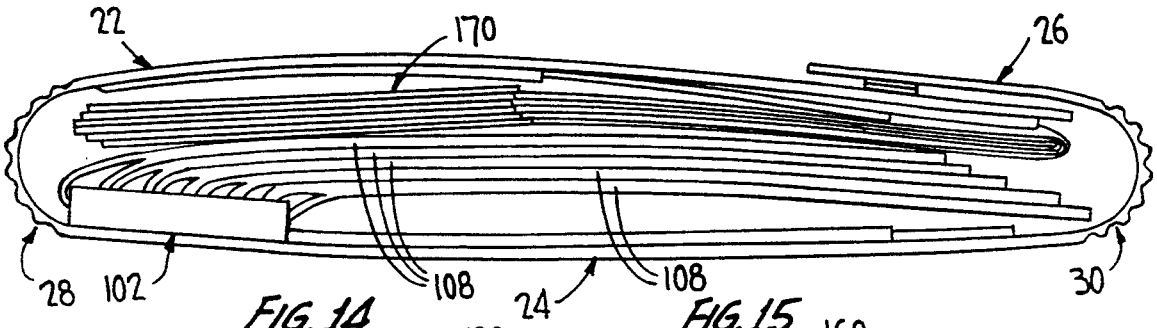
FIG. 8 is a front view of the case in closed position.

The case is adapted to be folded up progressively into the positions shown in FIGS. 7 and 8 of the drawings. Means is provided for detachably connecting the flap portion to the front portion of the case in the form of a first VELCRO member 90 secured to the outer side of the front portion of the case and a second cooperating VELCRO member 92 secured to the inner side of the flap portion of the case so that the case may be secured into the folded position shown in FIG. 8, yet easily opened when desired.

A pair of spaced brackets 100 and 102 formed of rigid plastic are secured to the relatively stiff part of the back portion 24. Bracket 100 is disposed adjacent the upper longitudinal edge 60 of the back portion, while bracket 102 is disposed adjacent the lower longitudinal edge 62 of the back portion. Bracket 100 includes a plurality of integral prongs 104 shown as being six in number, and bracket 102 also has six integral prongs 106 thereon, the prongs of each bracket extending toward the other bracket. The prongs are adapted to receive and support conventional multi-leafed devices such as notebooks 108 shown in full lines in FIGS. 6 and 8 and shown in phantom lines in FIG. 1, 4, 5 and 7.

The prongs 104 are longer than the prongs 106, and the brackets are spaced so that the distance between the opposed tips of the prongs 104 and 106 is less than the length of a multi-leafed device 108, said distance plus the length of the prongs 104 being at least as great as the length of the multi-leafed device, said distance plus the length of prongs 106 being less than the length of the multi-leafed device. Each multi-leafed device is supported on aligned prongs on the two brackets with the multi-leafed device being freely movable along the prongs.

Bracket 102 includes a body portion 110 integral with prongs 106, the body portion having a pair of cylindrical holes formed therethrough for receiving a pair of rivets 112 which pass through the back portion of the case to fixedly secure bracket 102 in place.

Figure 15:
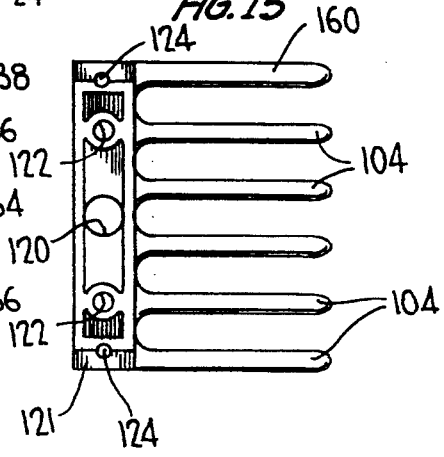
FIG. 15 is a top view of one of the brackets.

Referring now to FIG. 15 of the drawings, the undersurface of bracket 100 is shown. A central hole 120 is formed through the body portion 121, and a pair of holes 122 extend through the body portion on either side of the central hole. An additional pair of holes 124 extend into the body portion outwardly of holes 122. A depression 126 is formed on the opposite surface to the undersurface and has a predetermined width.

Figure 14:
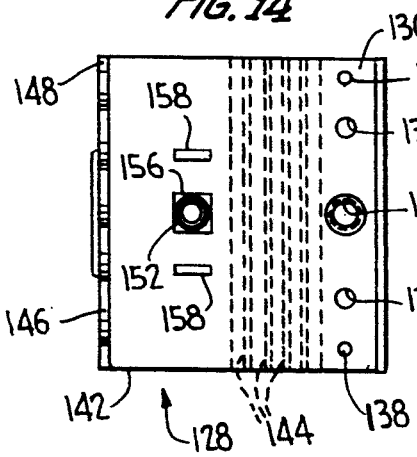
FIG. 14 is a top view showing the stop means and locking means associated with one of the brackets.

Referring to FIG. 14, a stop means indicated generally by reference character 128 and preferably formed of plastic includes a first portion 130 which is clamped between body portion 121 and the inner side of the back portion of the case so as to be fixedly mounted on the case adjacent the first bracket. An integral cylindrical tubular portion 132 extends from portion 130 and is received within hole 120. An annular ridge 134 extends inwardly from the inner surface of tubular portion 132 for a purpose hereinafter described. A pair of holes 136 are formed through portion 130 and are adapted to be aligned with holes 122 in bracket 100. A pair of substantially cylindrical protrusions 138 are formed integral with portion 130 and are adapted to fit snugly within holes 124 in bracket 100. When bracket 100 and stop means 128 are assembled in operative position, a pair of rivets 140 extend through holes 122 and 136 as well as the back portion of the case to hold the components in the assembled relationship shown in FIGS. 4 and 5.

The stop means includes a second portion 142 integral with portion 130 and is provided with a plurality of V-shaped grooves 144 formed in one side of a part thereof and which extend throughout the width thereof so that portion 142 may bend into the configuration shown in FIG. 5. The stop means is provided with a lip 146 which is adapted to be moved into operative position so that the lower edge 148 thereof engages prongs 104. This lower edge is scalloped as seen most clearly in FIG. 9 so that parts of the edge extend downwardly between the prongs. A surface 150 of the stop means is adapted to engage a lateral edge of an associated multi-leafed device to limit movement of the multi-leafed device along prongs 104 so that at least one prong of each of the brackets remains inserted between leafs of the multi-leafed device. The scalloped edge which extends down between prongs 104 ensures that a multi-leafed device will not slide past surface 150 even if there are some molding errors during manufacture of the components.

The second portion 142 of the stop means also includes a locking means for locking the stop means in the operative position shown in FIG. 5. The locking means includes an integral substantially cylindrical portion 152 which is adapted to be received within tubular portion 132. Portion 152 has a peripheral bead 154 formed on the outer surface thereof which snaps over the annular ridge 134 formed on the inner wall of tubular portion 132 to lock the components in position. Cylindrical portion 152 extends from an integral enlarged portion 156 on the second portion 142 and having a generally square cross-section. A pair of tabs 158 are integral with the second portion 142 and are disposed on either side of enlarged portion 156. The dimensions of the enlarged portion and the length of the tabs is such that they fit snugly within the depression formed in bracket 100 to stabilize the locking means when it is in engagement with prongs 104.

When a plurality of notebooks are mounted on the prongs 104 and 106, there may be a tendency for the notebook mounted on the prongs nearest to hinge means 28 and the front portion of the case to slide to the left as seen in FIG. 1. In order to resist such undesired movement, the prong 104 nearest to the front portion of the case includes a depending portion 160 as seen in FIGS. 4, 5 and 9. This depending portion reduces the distance between the undersurface of the prong and the inside surface of the back portion of the case, thereby minimizing the possibility of such undesired sliding movement.

Referring now to FIG. 10 of the drawings, sheet of material 162 formed of relatively stiff paper includes several components of the system according to the invention. The sheet includes a homework record card 163, a bookmark 164 and a pocket tag 166 which can be separated from one another along perforated lines 167 and 168. These components are separated and used individually as discussed herein. The homework record card has several lines at the top of the sheet to be filled in with the student's name, the school subject and the month of the year. A plurality of vertical columns are provided on the sheet to be filled in with the date on which homework is assigned, the homework assignment, the date on which the homework is due, and two columns are provided to be initialed by the parent and teacher indicating that the assignment has been completed. The pocket tag has a line to be filled in with a number which is arbitrarily chosen to identify a particular school subject, and a second line is provided to be filled in with the name of the school subject.

Figure 13:
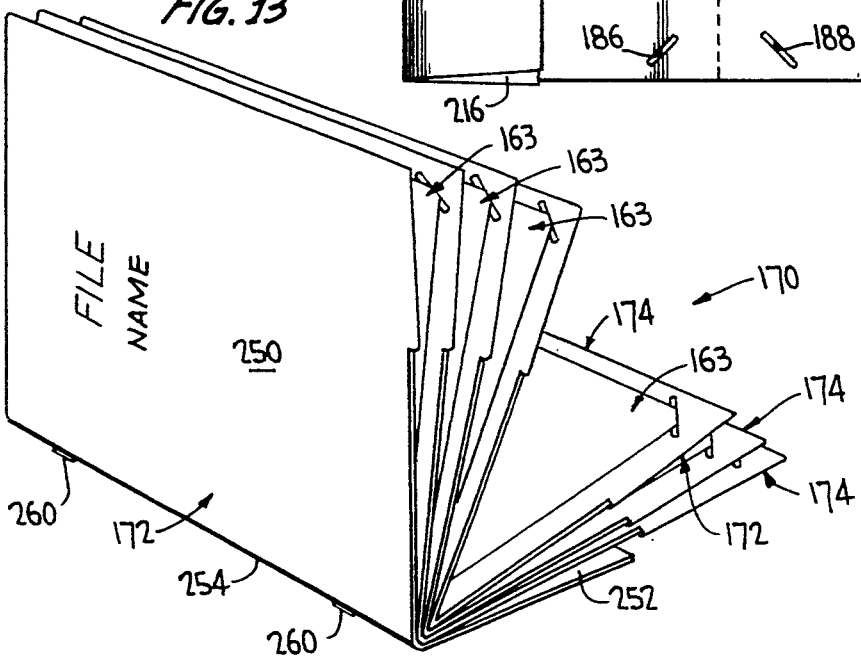
FIG. 13 is a top perspective view of the file partly opened with the members thereof in spaced relationship to one another.

Referring now to FIG. 13, a file is indicated generally by reference character 170 and includes a cover member 172 and a plurality of interior members 174 shown as being three in number. It should be understood that the number of interior members may be varied in accordance with the number of school subjects involved. The members of the file are made of relatively stiff sheet material such as heavy paper or cardboard and they are pivotally interconnected with one another as explained hereinafter.

Figure 11:
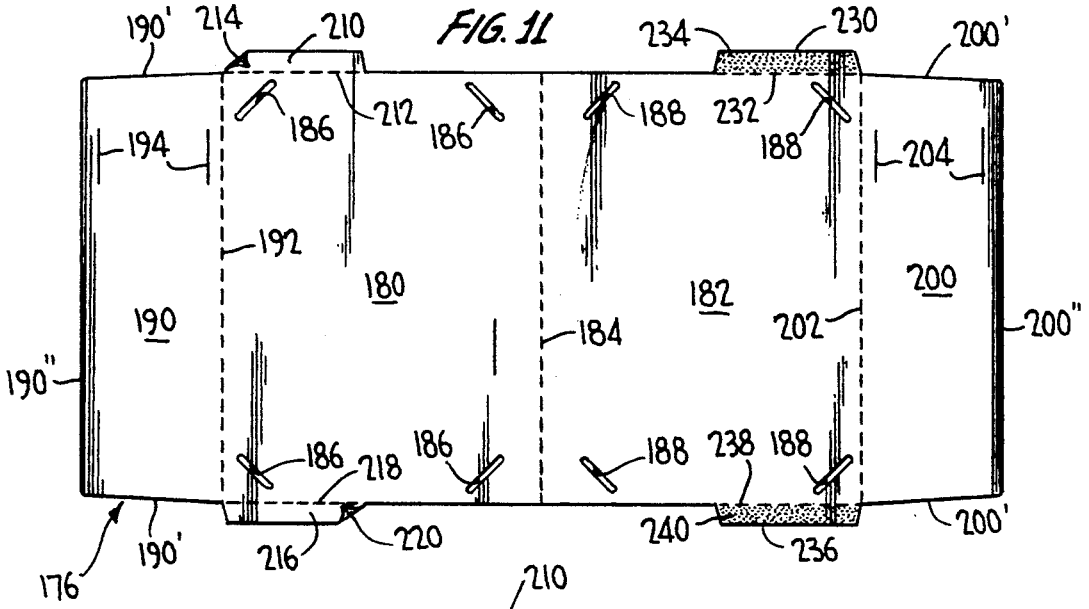
FIG. 11 is a top view of a blank forming one of the interior members of the file of the invention.

FIG. 11 illustrates a blank indicated generally by reference character 176 from which an interior member of the file is made. This blank comprises a single integral sheet of material including a pair of panels 180 and 182 separated from one another by a fold line 184. The panels 180 and 182 are each provided with four diagonally oriented spaced slots 186 and 188 respectively. These slots are spaced from one another by a distance which enables the four corners of a homework record card to be received therein so that each panel is adapted to support a homework record card thereon.

A storage pocket flap 190 is separated from panel 180 by a fold line 192 and has a pair of spaced slits 194 formed therethrough which are adapted to receive and support a pocket tag therein. Flap 190 has edges 190' which taper inwardly toward one another to join with an outer edge 190″. A further storage pocket flap 200 is separated from panel 182 by a fold line 202 and has a pair of spaced slits 204 formed therethrough which are adapted to receive and support a pocket tag therein. Flap 200 has edges 200′ which taper inwardly toward one anohter to join with an outer edge 200″.

A storage pocket side flap 210 is separated from panel 180 by a fold line 212, and as seen in FIG. 11 has adhesive material 214 disposed on the side of the flap facing away from the viewer. A further storage pocket side flap 216 is separated from panel 180 by a fold line 218 and has adhesive material 220 disposed on the side of the flap facing away from the viewer. A storage pocket side flap 230 is separated from panel 182 by a fold line 232, and has adhesive material 234 disposed on the side of the flap facing the viewer. A further storage pocket side flap 236 is separated from panel 182 by a fold line 238, and has adhesive material 240 disposed on the side of the flap facing the viewer.

Figure 12:
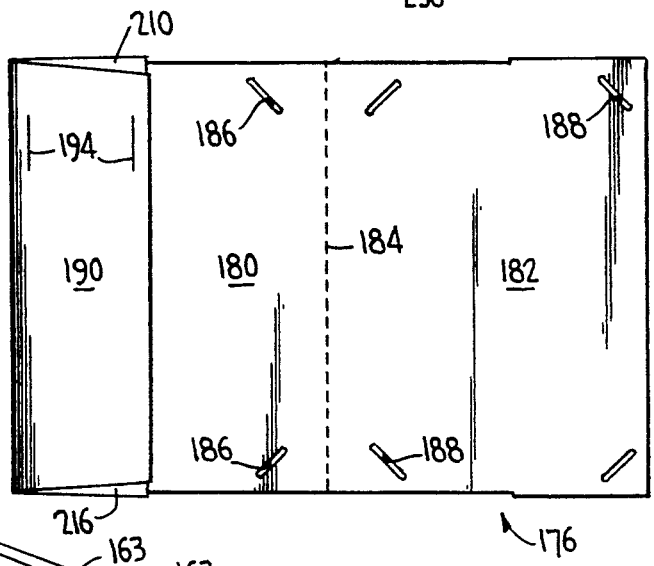
FIG. 12 is a view of the blank shown in FIG. 11 after the storage pockets have been formed thereon.

Referring now to FIG. 12, the blank shown in FIG. 11 is shown in folded position wherein integral pockets are formed on opposite faces of the two panels 180 and 182. Storage side flaps 210 and 216 and storage pocket flap 190 have been folded upwardly from the plane of the paper about the associated fold lines and then brought into contact with one another so that the adhesive material disposed on the side flaps adhesively secures the side flaps 210 and 216 to the adjacent surface of storage pocket flap 190 which is the surface facing the viewer in FIG. 11. The storage side flaps 230 and 236 and storage pocket flap 200 have been folded downwardly from the plane of the paper about the associated fold lines and then brought into contact with one another so that the adhesive material disposed on the side flaps adhesively secures the side flaps 230 and 236 to the adjacent surface of the storage pocket flap 200 which is the surface facing away from the viewer in FIG. 11.

When the blank shown in FIG. 11 has been folded into the position shown in FIG. 12, the interior member of the file includes a pair of panels each of which has an integral pocket thereon and which further has a plurality of slots formed therein. The interior member has opposite faces, one of which faces toward the viewer as seen in FIG. 11, and the other of which faces away from the viewer. The interior member therefore has integral pockets formed on opposite faces thereof so that any two adjacent panels of the interior member provides a storage pocket on one panel and slots for supporting a homework record card on the other panel. Each storage pocket also has spaced slits formed therein for receiving and supporting a pocket tag thereon. It should be understood that all of the interior members are of similar construction.

An assembled file is shown in FIG. 13, the cover member 172 being of different construction from the interior members. Cover member 172 includes a panel 250 and a support portion 252 separated from one another by a fold line 254. The blank from which the cover member is formed is similar to that shown in FIG. 11 with certain important modifications. The fold line 254 of the cover member blank corresponds to the fold line 184 shown in FIG. 11, and the cover member blank is identical to that shown in FIG. 11 to the left of the fold line 184 except that the slots 186 are eliminated. Therefore, panel 250 of the cover member is similar to panel 180 shown in FIG. 12 when folded into operative position with the exception that the cover member has no slots formed therein. In other words, panel 250 includes an integral storage pocket thereon in the same manner as the left hand portion of the interior member 176 shown in FIG. 12.

The support portion 252 of the cover member is approximately half the width of the panel 182 of the interior members and does not have any slots formed therein nor any pocket structure. Support portion 252 is simply a rectangular sheet of material which is adapted to slide within the file support pocket defined by the sheet of material 64 previously described. It is apparent that the file may be quickly and easily inserted or removed from the file support pocket when desired.

When the file is assembled into the position shown in FIG. 13, all of the fold lines 184 of the interior member and fold line 254 of the cover member are disposed adjacent one another. The members are pivotally interconnected with one another by a pair of staples 260 which extend through the fold lines to secure the members in operative relationship to one another.

When the file is fully assembled, homework record cards 163 may be inserted in slots 186 and 188 as shown in FIG. 13. As illustrated, the file is adapted to support six homework record cards therein. When the file is opened to any position therein, a homework record card is supported on the right-hand panel at that position, and an integral storage pocket is provided on the left-hand panel so that the materials relating to a particular school subject are stored together. The file may be readily replaced with a similar file when desired.

When it is desired to assemble the components of the system together, the case is opened up to lay flat. The notebooks are slid onto the prongs of the brackets and the stop means is locked in position to hold the notebooks in place. The name of the subjects can then be printed on the notebooks.

The file is then supported within the file support pocket in the case. The file is opened to the first page of the file to expose two adjacent panels of the file. The left-hand panel includes an integral storage pocket, and the right-hand panel has a plurality of slots formed therein. There is a homework record card of a color matching each color notebook. The appropriate homework record card is chosen for the notebook mounted at the left-hand prongs on the brackets. The card is separated along perforated lines into three pieces, namely the homework record card itself, a bookmark and a pocket tag. The ends of the pocket tag are slid into the slits in the storage pocket formed on the left-hand panel in the file. The pocket tag is filled in with the number and name of the school subject corresponding to that of the first notebook. The four corners of the homework record card are placed in the four slots on the right-hand panel of the file. The name of the subject of the first notebook is then filled in on the homework record card. The bookmark of similar color is placed in the textbook used with the first notebook.

The steps discussed above with respect to two adjacent panels in the file are then repeated with other pairs of adjacent panels for each of the other notebooks which relate to different school subjects. Any desired components may be stored in the utility storage pocket, and the bookmarks may be stored in the bookmark storage pocket, if desired. A pen or pencil is then inserted in the cooperating support pocket. The construction of the invention is now ready for use.

When a notebook or homework record card is filled, it can be removed and placed in a permanent file. Whenever a notebook or homework record card is removed, it should be replaced with a new one of the color. New papers should be placed on top of old papers in the storage pockets within the file to keep papers in order from newest to oldest in each storage pocket. The notebooks can be removed from the brackets during class or when doing homework, if desired.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. In combination, a case, a multi-leafed device supported by said case, said case including front and back portions the major parts of which are of relatively stiff construction, said front and back portions having outer and inner sides, hinge means interconnecting said front and back portions for swinging movement relative to one another, said front and back portions each including upper and lower longitudinal edges, a pair of spaced brackets secured to the relatively stiff part of said back portion, a first one of said brackets being disposed adjacent the upper longitudinal edge of said back portion, a second one of said brackets being disposed adjacent the lower longitudinal edge of said back portion, each of said brackets having a plurality of spaced prongs extending therefrom toward the other bracket, the prongs on said first one of said brackets being longer than the prongs on said second one of said brackets, the distance between the opposed tips of the prongs on the brackets being less than the length of said multi-leafed device, said distance plus the length of the prongs on said first bracket being at least as great as the length of said multi-leafed device, said distance plus the length of the prongs on said second bracket being less than the length of said multi-leafed device, at least one prong of each of said brackets being inserted between leaves of said multi-leafed device with said multi-leafed device being freely movable along said prongs, and stop means selectively movable to prevent inadvertent release of said multi-leafed device from said prongs so as to retain the multi-leafed device within said case, said stop means including a first portion fixedly mounted on said case adjacent said first bracket, and a second portion movably connected to said first portion for movement into and out of engagement with the prongs on said first bracket, said second portion when in engagement with the prongs of said first bracket including a surface for engaging a lateral edge of the multi-leafed device to limit movement of said multi-leafed device along the prongs of said first bracket so as to retain at least one prong of each of said brackets inserted between leaves of said multi-leafed device, and a plurality of support pockets disposed on the inner sides of said front and back portions, said support pockets being formed by sheets of material having opposite longitudinal edges, the opposite longitudinal edge of said sheets of material extending between and being secured to the upper and lower longitudinal edges respectively of said front and back portions, and a support pocket disposed on said front portion and a support pocket disposed on said back portion being formed by a single sheet of material having an intermediate part thereof sealed to said hinge means.

2. The combination of claim 1 wherein a part of said single sheet of material is sealed to said back portion to form a pen or pencil support pocket.

3. In combination, a case, a multi-leafed device supported by said case, said case including front and back portions the major parts of which are of relatively stiff construction, said front and back portions having outer and inner sides, hinge means interconnecting said front and back portions for swinging movement relative to one another, said front and back portions each including upper and lower longitudinal edges, a pair of spaced brackets secured to the relatively stiff part of said back portions, a first one of said brackets being disposed adjacent the upper longitudinal edge of said back portion, a second one of said brackets being disposed adjacent the lower longitudinal edge of said back portion, each of said brackets having plurality of spaced prong extending therefrom toward the other bracket, the prongs on said first one of said brackets being longer than the prongs on said second one of said brackets, the distance between the opposed tips of the prongs on the brackets being less than the length of said multi-leafed device, said distance plus the length of the prongs on said first bracket being at least as great as the length of said multi-leafed device, said distance plus the length of the prongs on said second bracket being less than the length of said multi-leafed device, at least one prong of each of said brackets being inserted between leaves of said multi-leafed device with said multi-leafed device being freely movable along said prongs, and stop means selectively movable to prevent inadvertent release of said multi-leafed device from said prongs so as to retain the multi-leafed device within said case, said stop means including a first portion fixedly mounted on said case adjacent said first bracket, and a second portion movably connected to said first portion for movement into and out of engagement with the prongs on said first bracket, said second portion when in engagement with the prongs of said first bracket including a surface for engaging a lateral edge of the multi-leafed device to limit movement of said multi-leafed device along the prongs of said first bracket so as to retain at least one prong of each of said brackets inserted between leaves of said multi-leafed device, and a plurality of support pockets disposed on the inner sides of said front and back portions, said support pockets being formed by sheets of material having opposite longitudinal edges, the opposite longitudinal edges of said sheets of material extending between and being secured to the upper and lower longitudinal edges respectively of said front and back portions, and a file support pocket being formed on said front portion by a sheet of material having side edges free of said front portion to form a support pocket open at both sides thereof.

4. In combination, case, a multi-leafed device supported by said case, said case including front and back portions the major parts of which are of relatively stiff construction, said front and back portions having outer and inner sides, hinge means interconnecting said front and back portions for swinging movement relative to one another, said front and back portions each including upper and lower longitudinal edges, a pair of spaced brackets secured to the relatively stiff part of said back portion, a first one of said brackets being disposed adjacent the upper longitudinal edge of said back portion, a second one of said brackets being disposed adjacent the lower longitudinal edge of said back portion, each of said brackets having a plurality of spaced prongs extending therefrom toward the other bracket, the prongs on said first one of said brackets being longer than the prongs on said second one of said brackets, the distance between the opposed tips of the prongs on the brackets being less than the length of said multi-leafed device, said distance plus the length of the prongs on said first bracket being at least as great as the length of said multi-leafed device, said distance plus the length of the prongs on said second bracket being less than the length of said multi-leafed device, at least one prong of each of said brackets being inserted between leaves of said multi-leafed device with said multi-leafed device being freely movable along said prongs, and stop means selectively movable to prevent inadvertent release of said multi-leafed device from said prongs so as to retain the multi-leafed device within said case, said stop means including a first portion fixedly mounted on said case adjacent said first bracket, and a second portion movably connected to said first portion for movement into and out of engagement with the prongs on said first bracket, said second portion when in engagement with the prongs of said first bracket including a surface for engaging a lateral edge of the multi-leafed device to limit movement of said multi-leafed device along the prongs of said first bracket so as to retain at least one prong of each of said brackets inserted between leaves of said multi-leafed device, and a plurality of support pockets disposed on the inner sides of said front and back portions, said support pockets being formed by sheets of material having opposite longitudinal edges, the opposite longitudinal edge of said sheets of material extending between and being secured to the upper and lower longitudinal edges respectively of said front and back portions, said second portion of the stop means including a scalloped edge for engaging the prongs of said first bracket and extending downwardly from said second portion.

5. In combination, a case, a multi-leafed device supported by said case, said case including front and back portions the major parts of which are of relatively stiff construction, said front and back portions having outer and inner sides, hinge means interconnecting said front and back portions for swinging movement relative to one another, said front and back portions each including upper and lower longitudinal edges, a pair of spaced brackets secured to the relatively stiff part of said back portion, a first one of said brackets being disposed adjacent the upper longitudinal edge of said back portion, a second one of said brackets being disposed adjacent the lower longitudinal edge of said back portion, each of said brackets having a plurality of spaced prongs extending therefrom toward the other bracket, the prongs on said first one of said brackets being longer than the prongs on said second one of said brackets, the distance between the opposed tips of the prongs on the brackets being less than the length of said multi-leafed device, said distance plus the length of the prongs on said first bracket being at least as great as the length of said multi-leafed device, said distance plus the length of the prongs on said second bracket being less than the length of said multi-leafed device, at least one prong of each of said brackets being inserted between leaves of said multi-leafed device with said multi-leafed device being freely movable along said prongs, and stop means selectively movable to prevent inadvertent release of said multi-leafed device from said prong so as to retain the multi-leafed device within said case, said stop means including a first portion fixedly mounted on said case adjacent said first bracket, and a second portion movably connected to said first portion for movement into and out of engagement with the prongs on said first bracket, said second portion when in engagement with the prongs of said first bracket including a surface for engaging a lateral edge of the multi-leafed device to limit movement of said multi-leafed device along the prongs of said first bracket so as to retain at least one prong of each of said brackets inserted between leaves of said multi-leafed device, and a plurality of support pockets disposed on the inner sides of said front and back portions, said support pockets being formed by sheets of material having opposite longitudinal edges, the opposite longitudinal edges of said sheets of material extending between and being secured to the upper and lower longitudinal edges respectively of said front and back portions, the prong on said first bracket nearest to said front portion including a depending portion to prevent a multi-leafed device from escaping from said last-mentioned prong.

6. In combination, a case, a multi-leafed device supported by said case, said case including front and back portions the major parts of which are of relatively stiff construction, said front and back portions having outer and inner sides, hinge means interconnecting said front and back portions for swinging movement relative to one another, said front and back portions each including upper and lower longitudinal edges, a pair of spaced brackets secured to the relatively stiff part of said back portion, a first one of said brackets being disposed adjacent the upper longitudinal edge of said back portion, a second one of said brackets being disposed adjacent the lower longitudinal edge of said back portion, each of said brackets having a plurality of spaced prongs extending therefrom toward the other bracket, the prongs on said first one of said brackets being longer than the prongs on said second one of said brackets, the distance between the opposed tips of the prongs on the brackets being less than the length of said multi-leafed device, said distance plus the length of the prongs on said first bracket being at least as great as the length of said multi-leafed device, said distance plus the length of the prongs on said second bracket being less than the length of said multi-leafed device, at least one prong of each of said brackets being inserted between leaves of said multi-leafed device with said multi-leafed device being freely movable along said prongs, and stop means selectively movable to prevent inadvertent release of said multi-leafed device from said prongs so as to retain the multi-leafed device within said case, said stop means including a first portion fixedly mounted on said case adjacent said first bracket and a second portion movably connected to said first portion for movement into and out of engagement with the prongs on said first bracket, said second portion when in engagement with the prongs of said first bracket including surface for engaging a lateral edge of the multi-leafed device to limit movement of said multi-leafed device along the prongs of said first bracket so as to retain at least one prong of each of said brackets inserted between leaves of said multi-leafed device, and a plurality of support pockets disposed on the inner sides of said front and back portions, said support pockets being formed by sheets of material having opposite longitudinal edges, the opposite longitudinal edges of said sheets of material extending between and being secured to the upper and lower longitudinal edges respectively of said front and back portions, and including locking means for locking the stop means in engagement with the prongs of the first bracket, said second portion of the stop means having tab means extending therefrom, said first bracket having an upper surface with a depression formed therein, said tab means fitting snugly within said depression to stabilize the locking means when the locking means is in engagement with the prongs of the first bracket.

7. In combination, a case, a multi-leafed device supported by said case, said case including front and back portions the major parts of which are of relatively stiff construction said front and back portions having outer and inner sides, hinge means interconnecting said front and back portions for swinging movement relative to one another, said front and back portions each including upper and lower longitudinal edges, a pair of spaced brackets secured to the relatively stiff part of said back portion, a first one of said brackets being disposed adjacent the upper longitudinal edge of said back portion, a second one of said brackets being disposed adjacent the lower longitudinal edge of said back portion, each of said brackets having a plurality of spaced prongs extending therefrom toward the other bracket, the prongs on said first one of said brackets being longer than the prongs on said second one of said brackets, the distance between the opposed tips of the prongs on the brackets being less than the length of said multi-leafed device, said distance plus the length of the prongs on said first bracket being at beast as great as the length of said multi-leafed device, said distance plus he length of the prongs on said second bracket being less than the length of said multi-leafed device, at least one prong of each of said brackets being inserted between leaves of said multi-leafed device with said multi-leafed device being freely movable along said prongs, and stop means selectively movable to prevent inadvertent release of said multi-leafed device from said prongs so as to retain the multi-leafed device within said case, said stop means including a first portion fixedly mounted on said case adjacent said first bracket, and a second portion movably connected to said first portion for movement into and out of engagement with the prongs on said first bracket, said second portion when in engagement with the prongs of said first bracket including surface for engaging a lateral edge of the multi-leafed device to limit movement of said multi-leafed device along the prongs of said first bracket so as to retain at least one prong of each Of said brackets inserted between leaves of said multi-leafed device, and a plurality of support pockets disposed on the inner sides of said front and back portions, said support pockets being formed by sheets of material having opposite longitudinal edges, the opposite longitudinal edges of said sheets of material extending between and being secured to the upper and lower longitudinal edges respectively of said front and back portions, said first one of said brackets having a first hole formed therethrough and having a pair of holes extending into said first one of said brackets on opposite sides of said first hole, said stop means having an integral tubular portion received within said first hole and a pair of integral protrusions thereon fitting snugly within said pair of holes whereby the stop means can be attached to said first bracket prior to the first bracket and stop means being connected to the case.

8. In combination, a case, a multi-leafed device and a file supported by said case, said case including front and back portions the major parts of which are of relatively stiff construction, said front and back portions having outer and inner sides, hinge means interconnecting said front and back portions for swinging movement relative to one another, said front and back portions each including upper and lower longitudinal edges, a pair of spaced brackets secured to the relatively stiff part of said back portion, a first one of said brackets being disposed adjacent the upper longitudinal edge of said back portion, a second one of said brackets being disposed adjacent the lower longitudinal edge of said back portion, each of said brackets having a plurality of spaced prongs extending therefrom toward the other bracket, the prongs on said first one of said brackets being longer than the prongs on said second one of said brackets, the distance between the opposed tips of the prongs on the brackets being less than the length of said multi-leafed device, said distance plus the length of the prongs on said first bracket being at least as great as the length of said multi-leafed device, said distance plus the length of the prongs on said second bracket being less than the length of said multi-leafed device, at least one prong of each of said brackets being inserted between leaves of said multi-leafed device with said multi-leafed device being freely movable along said prongs, and stop means selectively movable to prevent inadvertent release of said multi-leafed device from said prongs so as to retain the multi-leafed device within said case, said stop means including a first portion fixedly mounted on said case adjacent said first bracket, and a second portion movably connected to said first portion for movement into and out of engagement with the prongs on said first bracket, said second portion when in engagement with the prongs of said first bracket including a surface for engaging a lateral edge of the multi-leafed device to limit movement of said multi-leafed device along the prongs of said first bracket so as to retain at least one prong of each of said brackets inserted between leaves of said multi-leafed device, a file support pocket disposed at the inner side of said front portion, said file including a cover member and a plurality of interior members pivotally connected to one another, said cover member including a supporting portion fitting within said file support pocket to support the file in operative position, said cover member having an integral storage pocket thereon, and each of said interior members having a plurality of integral storage pockets thereon.

9. The combination of claim 8 wherein each of said interior members has integral storage pockets formed on opposite faces thereof.

10. The combination of claim 8 wherein each of said interior members includes a pair of panels separated by a fold line, each of said panels having a plurality of slots formed therein for receiving the corners of homework record cards.

11. The combination of claim 10 including a homework record card having a plurality of corners, each of said corners extending through one of said slots.

12. The combination of claim 8 wherein each of said storage pockets has spaced slits formed therein, a pocket tag having opposite ends, the opposite ends of said pocket tag extending through the slits of one of said storage pockets to support the pocket tag on the storage pocket.

13. The combination of claim 8 wherein said first one of said brackets has a first hole formed therethrough and has a pair of holes extending into said first one of said brackets on opposite sides of said first hole, said stop means having an integral tubular portion received within said first hole and a pair of integral protrusions thereon fitting snugly within said pair of holes whereby the stop means can be attached to said first bracket prior to the first bracket and stop means being connected to the case.

14. A file comprising a cover member and a plurality of interior members, said cover member including a panel and a support portion separated by a fold line, the panel of said cover having an integral storage pocket thereon, each of said interior members including a pair of panels separated by a fold line, said cover member and said interior members being pivotally interconnected with one another along said fold lines, each of the panels of said interior members having an integral pocket thereon and having a plurality of slots formed therein.

15. A file as defined in claim 14 wherein each of said interior members has opposite faces, the integral pockets formed on each interior member being disposed on opposite faces of the interior member, so that any two adjacent panels within said file provides a storage pocket on one panel and slots for supporting a homework record card on the other panel.

16. A file as defined in claim 15 including a homework record card having a plurality of corners, each of said corners extending through one of said slots.

17. A file as defined in claim 14 wherein each of said storage pockets has spaced slits formed therein for receiving and supporting a pocket tag thereon.

18. A file as defined in claim 17 including a pocket tag having opposite ends, the opposite ends of said pocket tag extending through the slits of one of said storage pockets to support the pocket tag on the storage pocket.

* * * * *

UNITED STATES PATENT AND TRADEMARK OFFICE

CERTIFICATE OF CORRECTION

PATENT NO. : 5,366,248

DATED : November 22, 1994

INVENTOR(S) : Robert G. Donovan et al.

It is certified that error appears in the above-identified patent and that said Letters Patent is hereby corrected as shown below:

Title page, item [75] should read as follows:

[76] Inventors: Robert G. Donovan; Michael D. Donovan, both of 15 East La., Pittston, Pa. 18640

Signed and Sealed this

Twenty-eight Day of March, 1995

Bruce Lehman

*Attest:*

BRUCE LEHMAN

*Attesting Officer*

*Commissioner of Patents and Trademarks*